United States Patent [19]

Hickey

[11] Patent Number: 4,698,732

[45] Date of Patent: Oct. 6, 1987

[54] CARRIER FOR TRICK-OR-TREATING OR THE LIKE

[76] Inventor: Charles P. Hickey, 1904-27 St., Monroe, Wis. 53566

[21] Appl. No.: 796,964

[22] Filed: Nov. 12, 1985

[51] Int. Cl.[4] ..... F21V 33/00

[52] U.S. Cl. ..... 362/154; 362/156; 362/208; 446/485

[58] Field of Search ..... 362/253, 156, 154, 208; 446/485; 272/1 R, 8 R, 8 N; D32/53, 54; D21/59, 120; D26/38, 51; 150/48, 50; 220/307

[56] References Cited

U.S. PATENT DOCUMENTS

| | | | |
|---|---|---|---|
| D. 209,067 | 10/1967 | Tarrson | D21/120 |
| 1,208,445 | 12/1916 | Arnold | 150/50 |
| 1,289,410 | 12/1918 | Day | 150/50 |
| 2,428,133 | 9/1947 | Yogan | 446/485 |
| 3,258,589 | 6/1966 | Doring | 362/208 |
| 3,822,170 | 7/1974 | Smolen | 362/351 |

*Primary Examiner*—E. Rollins Cross

*Attorney, Agent, or Firm*—Andrus, Sceales, Starke & Sawall

[57] ABSTRACT

In one embodiment, a carrier (1) is provided which comprises a generally bucket-shaped container (2) which has an open top (4) for collection of items, and which may have a handle (8) if desired. The container is provided with a bottom portion (5) having an opening (15) therein for receiving a light source such as a flashlight (10). The flashlight is suitably held in position, as by a press fit against the edge of the opening, and extends between the interior and exterior of the container. Depending upon the direction the flashlight is pointed, the light will either point downwardly to light the way of the user in the dark, or alternately may cause the container itself to light up when a translucent container material is used. In another embodiment, a pair of generally similar containers (17, 18) of the type described above are joined at their bottom portions so that one container opens upwardly and one downwardly. Openings in the bottoms of the containers are positioned in registry to provide a single opening which receives a light source such as a flashlight, as by a press fit. When the flashlight points downwardly, it causes the lower container (18 ) to glow when a translucent container material is used; and furthermore shines a light through the open end of the lower container which impinges on the ground.

12 Claims, 4 Drawing Figures

CARRIER FOR TRICK-OR-TREATING OR THE LIKE

BACKGROUND AND SUMMARY OF THE INVENTION

This invention relates to a carrier for trick-or-treating or the like, and more particularly to a carrier for use by small children for collecting items by going door-to-door in times of darkness.

Trick-or-treating has for many years been a popular activity by small children at Halloween time. Although this is sometimes done during the day, some children continue to trick-or-treat at night. At such times, the child may have difficulty in seeing where he or she is going. Additionally, a child crossing the street may be in danger of not being seen by an oncoming motorist. Because of these and other factors, there has been a need to increase the safety of the child while permitting the collection of items with ease.

The present invention is directed to a carrier which increases the ability of the user to see in the darkness, which improves the visibility of the user, and which also facilitates the collection of numerous items.

In accordance with the various aspects of the invention, and in the broadest sense, a carrier is provided which comprises a generally bucket-shaped container which has an open top for collection of items, and which may have a handle if desired. The container is provided with a bottom portion having an opening therein for receiving a light source such as a flashlight. The flashlight is suitably held in position, as by a press fit against the edge of the opening, and extends between the interior and exterior of the container. Depending upon the direction the flashlight is pointed, the light will either point downwardly to light the way of the user in the dark, or alternately may cause the container itself to light up when a translucent container material is used. The flashlight blocks and prevents items from falling through the opening.

In another embodiment, a pair of generally similar containers of the type described above are joined at their bottom portions which abut so that one container opens upwardly and one downwardly. Openings in the bottoms of the containers are positioned in registry to provide a single opening which receives a light source such as a flashlight, as by a press fit. When the flashlight points downwardly, it causes the lower container to glow when a translucent container material is used; and furthermore shines a light through the open end of the lower container which impinges on the ground. The opposite end of the flashlight extends upwardly into the interior of the upper container and prevents items collected therein from falling through the opening. In the event the handle on the upper container breaks or becomes unusable, the entire assembly may be inverted and the position of the flashlight reversed to thereby provide a further carrier substantially identical to the original one.

BRIEF DESCRIPTION OF THE DRAWINGS

The accompanying drawings illustrate the best mode presently contemplated by the inventor for carrying out the invention.

In the drawings.

DESCRIPTION OF THE PREFERRED EMBODIMENTS

Figure 1:
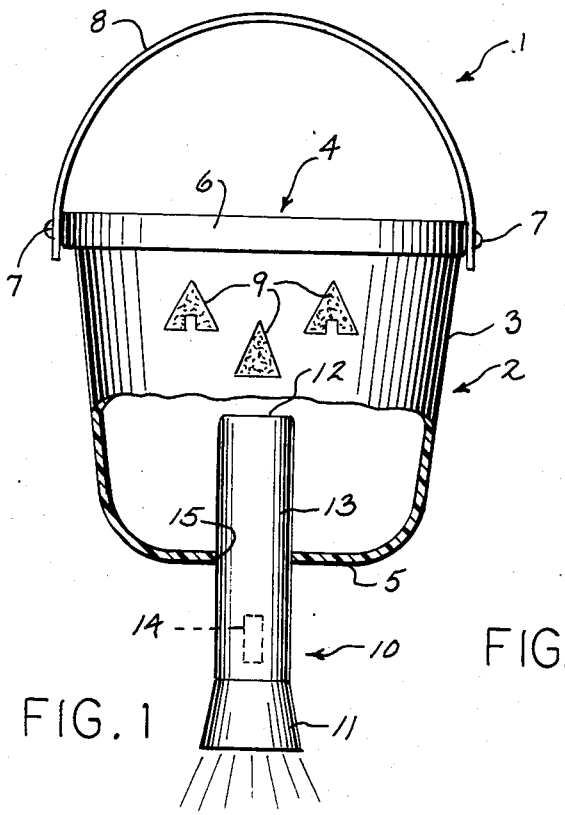
FIG. 1 is a front elevation of a carrier constructed in accordance with the broader aspects of the invention, with parts broken away.

As shown in the embodiment of FIG. 1, a carrier 1 for trick-or-treating or the like is provided which comprises a bucket-like container 2 having a generally cylindrical side wall 3 which tapers slightly between an open top portion 4 and a generally flat bottom wall 5. The upper end of side wall 3 may be provided with a thickened rim 6 to which is attached, as by rivets 7, an arcuate carrying handle 8 which may be pivoted about the rivets between a retracted position and an upright carrying position, as shown. Container 2 may be made of any suitable material, but preferably of light-weight molded translucent plastic, such as polyethylene, and may be colored orange and provided with face-like decorations 9 to emulate a Halloween pumpkin. Likewise, handle 8 may be made of any suitable material, but preferably of thin plastic which may be colored black.

The interior of container 2 is adapted to form a receptacle for receiving trick-or-treat or other items dumped in through in top.

Container 2 is adapted to function in conjunction with a light source which lights the exterior surroundings of the carrier user, or which alternately causes the walls of the carrier to glow from the interior thereof. For this purpose, the light source is mounted to the container and in the present embodiment comprises a flashlight 10 having a front lightable end 11 and a tail end 12 joined by a central body portion 13. A manually operable switch 14 is mounted to body portion 13 in the usual manner. Flashlight 10 is suitably secured to bottom wall 5 and extends therethrough. In the present embodiment, an opening 15 is formed centrally of wall 5 and flashlight 10 is press fit thereinto so that friction holds it in place and so that the opening is blocked.

In the embodiment of FIG. 1, flashlight 10 may be alternately selectively positioned with its lightable end 11 either down or up, the drawing showing end 11 in the down position disposed exteriorly of container 2. In this position, the activated flashlight will illuminate the exterior environment, and especially the ground, for the safety of the user. If the flashlight position is reversed relative to container 2, walls 3 and 5 will glow translucently and thus make the user more visible to others.

As a child or other person collects a variety of items and dumps them into container 2, the items will collect around the body of flashlight 10 and will be prevented thereby from falling through opening 15.

Figure 2:
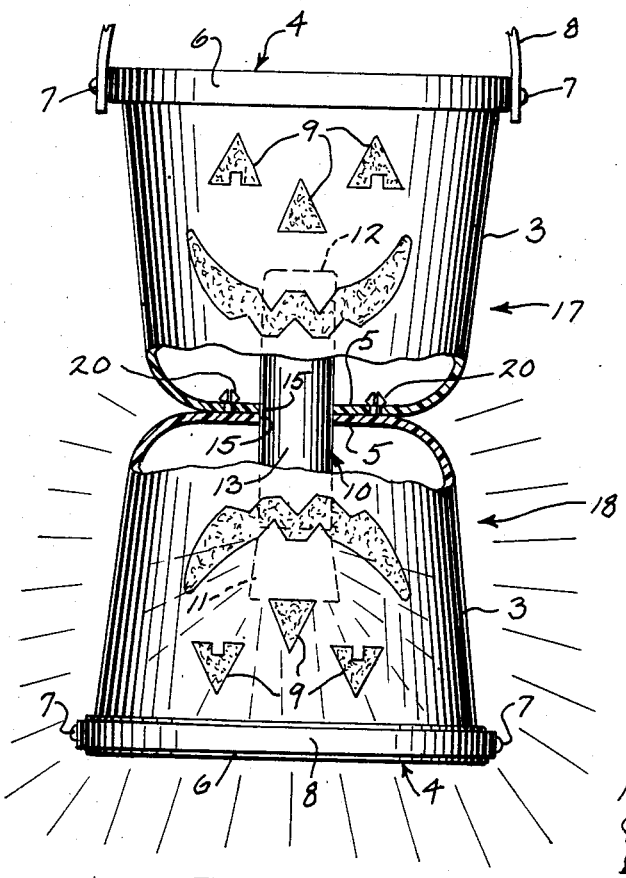
FIG. 2 is a front elevation of a second embodiment of carrier, with parts broken away.
Figure 3:
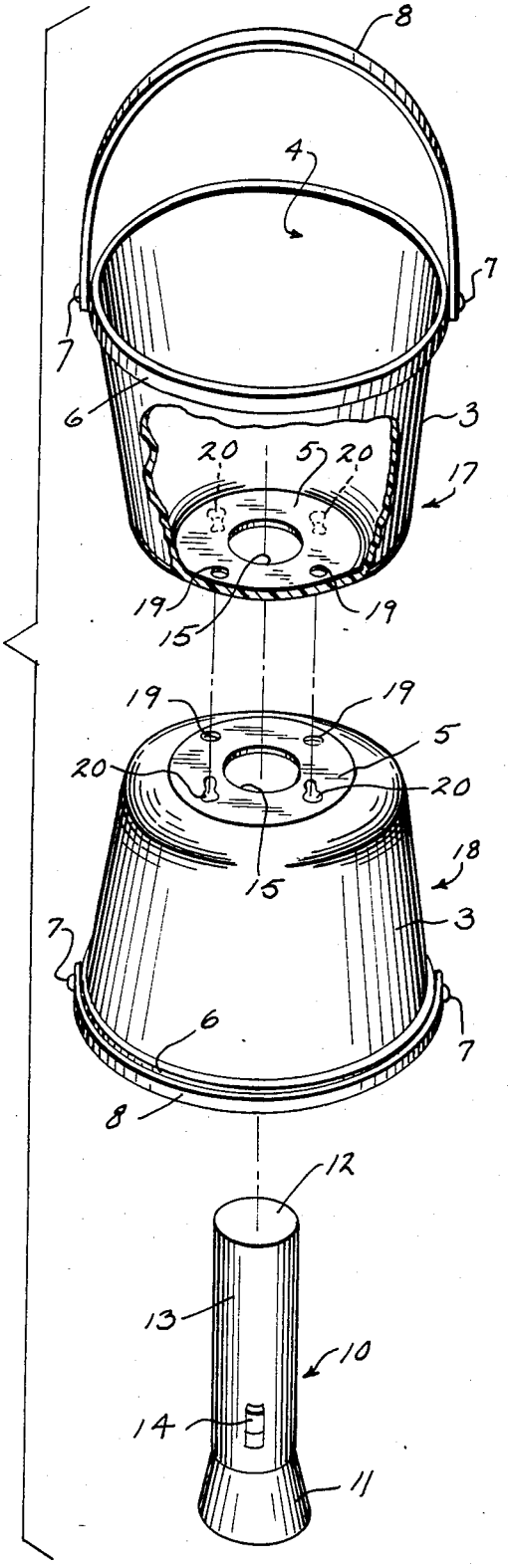
FIG. 3 is an exploded view of the carrier of FIG. 2, taken from the back side thereof.
Figure 4:
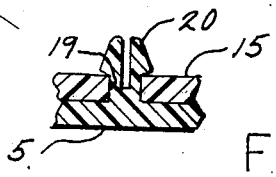
FIG. 4 is an enlarged fragmentary sectional view of the container joining means of the present embodiment.

Turning now to the embodiment of FIGS. 2–4, a carrier 16 comprises an assembly of a pair of upper and lower containers 17 and 18, respectively. These containers are contemplated as being generally similar to container 2 of the embodiment of FIG. 1, with at least one container being translucent and with like parts being similarly numbered. It is preferable that both containers are translucent. Containers 17 and 18 are joined in mutually inverted positions at their bottom walls 5 by any suitable joining means. In the present embodiment, each bottom wall 5 is provided with a pair of circumferentially spaced holes 19 as well as a pair of circumferentially spaced projections 20. Holes 19 and projections 20 may be formed in the molding process, and each pair is positioned in side-by-side relationship so that both containers may be formed in a single mold.

In assembling carrier 16, containers 17 and 18 are invertedly positioned with their bottom walls 5 facing each other, and with the respective holes 19 and projections 20 as well as the pair of central openings 15 in facing relationship. The containers are then brought together to cause projections 20 to snap into holes 19, and so that openings 15 are in registry, to form a single pass-through opening into which a flashlight 10 may be press fit.

With flashlight 10 selectively positioned as shown, with its lightable end portion 11 down, when the user carries carrier 16 by handle 8 of upper container 17, flashlight 10 causes the walls 3 and 5 of bottom container 18 to glow, as shown, and also shines light through opening 4 of inverted bottom container 18 and onto the ground. The upright upper container 17 serves as the receptacle for receiving candy and the like, with flashlight body portion 13 preventing loss of the carried items through the aligned openings 15. If for some reason the user wishes to observe an object above him or her, the user need only invert the entire assembly so that light will shine upwardly through the now top opening 4 of container 18.

In the event that handle 8 of upper container 17 breaks or becomes unusable, and if the user wishes to continue using carrier 16 with the light source facing downwardly, the entire assembly can be inverted and the position of the flashlight 10 selectively reversed. The result is to create a substantially identical carrier as that shown, only it will be carried by handle 4 of the now upper container 18. The safety glow and light beam will emanate from the now lower container 17, with container 18 used for collection of items.

When containers 17 and 18 are joined, as by the snap-together arrangement, the entire assembly may be easily taken apart for storage. This is especially facilitated when containers 17 and 18 are formed with tapered side walls 3 as shown, because the containers may then be stacked and nested together. Shipping of large numbers of stacked containers is also made easier.

The various aspects of the invention provide a unique concept for carriers for use in trick-or-treating or the like where a number of items are to be accumulated and carried in darkness. The concepts of the invention provide a container for the items, light to show the way, as well as a visual warning for oncoming motorists.

Various modes of carrying out the invention are contemplated as being within the scope of the following claims particularly pointing out and distinctly claiming the subject matter which is regarded as the invention.

I claim:

1. A carrier for use wherein a number of items are to be accumulated and carried in darkness, said carrier comprising, in combination:

(a) a unitary carryable bucket-like container (2, 17 or 18) having an open top (4), a side wall (3) and a bottom wall (5), (b) an opening (15) disposed in and of reduced diameter relative to said bottom wall (5), (c) and light source means (10, 13, 11) for preventing items accumulated in said container through said open top from falling through said opening.

2. The carrier of claim 1 in which:

(a) said last-named means comprises a light source (10) having a body (13) and a lightable portion (11), (b) and means mounting said light source to said bottom wall (5) so that said opening (15) is blocked.

3. The carrier of claim 2 in which said light source (10) is selectively positionable with its said lightable portion (11) disposed alternately within said container or exteriorly thereof.

4. The carrier of claim 3 in which said container is translucent so that its said walls (3, 5) glow when said lightable portion (11) is disposed within said container and is activated.

5. The carrier of claim 4 in which said light source mounting means comprises a press fit between said light source body (13) and the edge of said opening (15) formed by frictional engagement therebetween.

6. A carrier for use wherein a number of items are to be accumulated and carried in darkness, said carrier comprising, in combination:

(a) a pair of bucket-like containers (17, 18) and with each container having an open top (4), a side wall (3) and a bottom wall (5), (b) mounting means (19, 20) for joining said bottom walls (5) of said containers (17, 18) in abutting relationship so that one container (17) is adapted to be upright for carrying items and the other container (18) is adapted to be inverted, (c) openings (15) disposed in said bottom walls of said containers and with said openings being in registry, (d) and light source means (10, 13, 11) for preventing items accumulated in said upright container (17) from falling through said openings (15).

7. The carrier of claim 6 in which:

(a) said last-named means comprises a light source (10) having a body (13) and a lightable portion (11), (b) and means mounting said light source so that it extends through and blocks said openings.

8. The carrier of claim 7 in which said light source means (10) is selectively positionable with its said lightable portion (11) disposed alternately within said upper container (17) or said lower container (18).

9. The carrier of claim 8 in which at least one of said containers (17, 18) is translucent so that its said walls (3, 5) glow when said lightable portion (11) is disposed therewithin.

10. The carrier of claim 9 in which:

(a) each of said containers (17, 18) includes a carrying handle (8), (b) and said carrier is selectively invertable for carrying by either said handle.

11. The carrier of claim 10 in which said light source mounting means comprises a press fit between said light source body (13) and the edge of said openings (15) formed by frictional engagement therebetween.

12. The carrier of claim 10 in which said containers (17, 18), when separated, are stackable and nestable.

* * * * *